United States Patent [19]

Simon

[11] 4,348,070

[45] Sep. 7, 1982

[54] INSULATION FOR FLAT CONNECTORS

[76] Inventor: Hans Simon, Bruchhausener Strasse, 5463 Unkel, Rhein, Fed. Rep. of Germany

[21] Appl. No.: 102,976

[22] Filed: Dec. 11, 1979

[30] Foreign Application Priority Data

Sep. 4, 1979 [DE] Fed. Rep. of Germany ... 7925002[U]

[51] Int. Cl.[3] ..... H01R 13/48

[52] U.S. Cl. ..... 339/59 R; 339/276 F

[58] Field of Search ..... 339/59, 206, 207, 209, 339/210, 256 SP, 258 S, 276 F

[56] References Cited

U.S. PATENT DOCUMENTS 3,332,053 7/1967 Busler ..... 339/210 R

FOREIGN PATENT DOCUMENTS 2424898 12/1974 Fed. Rep. of Germany ... 339/210 M 2024537 1/1980 United Kingdom ..... 339/59 M 2027291 2/1980 United Kingdom ..... 339/59 M

*Primary Examiner*—Joseph H. McGlynn

*Attorney, Agent, or Firm*—Steinberg & Raskin

[57] ABSTRACT

The invention relates to an insulation for flat connectors comprising a plastic housing shaped as one piece including embedding and insertion openings and a hinged lid for closing the embedding opening, wherein said embedding opening is provided in a side wall of said housing, as seen in the insertion direction, and said lid is hinged near said embedding opening via a hinge frame and may be rotated to close said insertion opening and be arrested by one or a plurality of latches.

5 Claims, 11 Drawing Figures

INSULATION FOR FLAT CONNECTORS

The present invention relates to an insulation for flat connectors including conventional flat connectors as well as angularly shaped flat connectors, which is reliable, moderate in price, and easily mounted and has at the same time small dimensions.

Insulations for flat connectors of various shapes are already been known. Insertion of the connectors into most of such insulations may be effected from the rear side, i.e. from the side averted from the insertion opening for the flat plug. For the fixation of the flat connector, edges are provided in the interior of some embodiments of prior art insulations behind which a latch member on the flat connector may engage. Other embodiments of prior art insulations include only a flexible rear wall which may be bent open but retains the flat connector only inadequately.

A further embodiment comprises two housing halves connected with one another by a hinge frame. In the interior of these two halves, edges are provided which engage behind the beaded portions of the embedded flat connector and should provide a firm fixation. However, this is frequently not the case because, in view of the frequently inadequate closure mechanism, the two halves tend to snap open when the contact pin is inserted.

The two above mentioned kinds of flat contactor insulations require moreover rather costly manufacturing processes so that in addition to the complicated mounting, relatively high manufacture costs have to be considered.

It is now the aim of the present invention, to provide an insulation for flat connectors comprising a plastic housing shaped as one piece including insertion and embedding openings and a hinged lid for closing the embedding opening which does not include the above-mentioned disadvantages and which is characterized by a great reliability, moderate price, and easy mounting while at the same time the dimensions are kept very small.

This object of the invention is solved by an insulation for flat connectors of the kind described hereinabove, which is characterized in that the embedding opening is provided in a side wall of the housing as seen in the inserting direction and the lid is hinged near the insertion opening via a hinge frame and may be rotated to close said embedding opening and be arrested by one or a plurality of latches.

It has been shown in this connection to be particularly advantageous if the embedding opening is provided on a narrow side of the housing as this warrants a substantially greater stability of the insulation.

In accordance with a particularly advantageous embodiment of the present invention, a bar is provided on one side of the housing arresting the beaded portions of the embedded flat connector and extending from the embedding opening at right angles relative to the inserting direction. Such a bar, integrally shaped with the housing, arrests the embedded flat connector safely within the housing so that it will not become loose when pushing it onto the contact pin.

In accordance with a further advantageous embodiment of the present invention, the wall opposite the insertion opening is at least partly slotted, which slot opens from the embedding opening.

With the aid of such an embodiment of the present insulation, both angularly shaped flat connectors as well as conventional connectors, i.e. flat connectors which are not angularly shaped, may be insulated, as in the latter case the connecting cable may be guided through the slot. It has in this connection been shown to be particularly suitable if the slotted wall is provided, at the cable exit, with a clearance corresponding to the cable thickness.

The stability of the insulation for flat connectors according to the invention is further increased in accordance with a further embodiment in that the lid closing the embedding opening is provided with a surrounding edge which may be inserted into the embedding opening.

When closing the lid, this integrally attached edge rests in the embedding opening thus stabilizing the preferably rectangular housing against torsions.

In accordance with another advantageous embodiment of the present invention, a plurality of insulations are combined to constitute a one-piece insulation block. The latter is suitably shaped as one piece and manufactured by injection molding.

The wall opposite the insertion openings is provided with an elastic, flexible wall portion.

The embedding openings of the insulation block may suitably be closed by one single lid which may advantageously be arrested with the front edge thereof behind a latch provided as one piece and arranged on the elastic wall portion.

In accordance with a further embodiment of the present invention, a latch is provided at the front edge of the lid, the latch engaging under the lower edge of the elastic wall portion.

The insulation according to the present invention is suitably manufactured by injection molding from a viscous-solid plastic material. Polyamide plastic materials have proved to be particularly suited.

Manufacture may be performed in a simple two-part mold, as all portions of the insulation including the cover lid, which closes the embedding opening, are shaped as an integral unity.

The exemplified embodiments shown in the accompanying drawings serve to further explain the invention. In the drawings.

Figure 1:
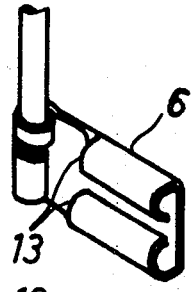
FIG. 1 is an angularly shaped flat connector which is to be embedded, and insulated, respectively, within the insulation according to the present invention.
Figure 2:
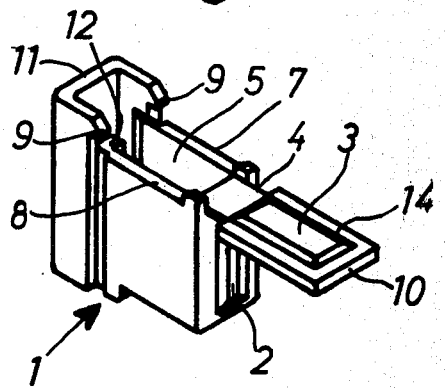
FIG. 2 is a perspective view of the insulation according to the present invention.
Figure 3:
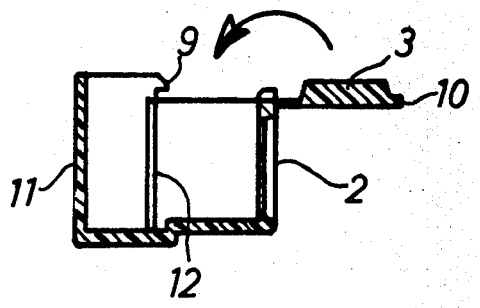
FIG. 3 is a side view in cross section of the insulation according to the present invention.
Figure 4:
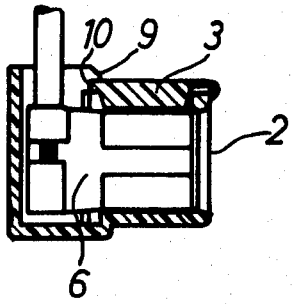
FIG. 4 is a cross sectional top view of the insulation according to the present invention with the angularly shaped flat connector embedded.

The insulation according to the present invention shown in the accompanying drawing comprises essentially a right-angled housing 1, which includes an embedding opening 5 formed in a first side wall and an insertion opening 2 formed in a second narrow side wall extending transversely with respect to the first side wall whereof a cover lid 3 is integrally attached via a hinge frame 4. By means of the hinge frame 4, cover lid 3 may be turned about 180° and located over the embedding opening 5 for the angularly shaped flat connector 6.

The side walls 7 and 8 include two latches 9 behind which edge 10 of the cover lid engages.

Figure 5:
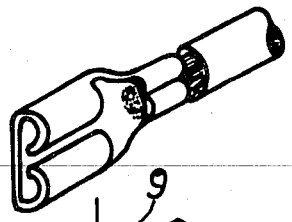
FIG. 5 is a flat connector without the angular design.

As shown in FIG. 5, the rear wall 11 may include a small slot accessible from the embedding opening 5 for the insulation of non-angularly-shaped flat connectors, which slot extends at least partly over the rear wall 11 and through which the cable connected to the flat connector is guided out of the insulation.

The flat connector 6 to be embedded into the insulation is fixed by bar 12, which engages behind the two beaded portions 13, against the forces acting in the insertion direction. Cover lid 3 is provided with a surrounding edge 14, which extends into the embedding opening 5 thus stabilizing the housing.

Figure 6:
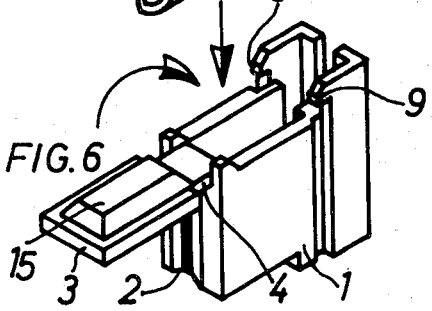
FIG. 6 is an insulation having a slotted rear wall.
Figure 7:
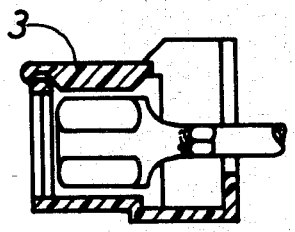
FIG. 7 is the insulation according to FIG. 6 with the flat connector embedded, in cross section.

In FIG. 6, an embodiment of the present invention is shown, wherein the rear wall is slotted so that a normal flat connector according to FIG. 5 may be embedded. Cover lid 3 is provided with a projection 15, which may be inserted into housing 1, and by which the insulation is substantially stabilized.

Figure 8:
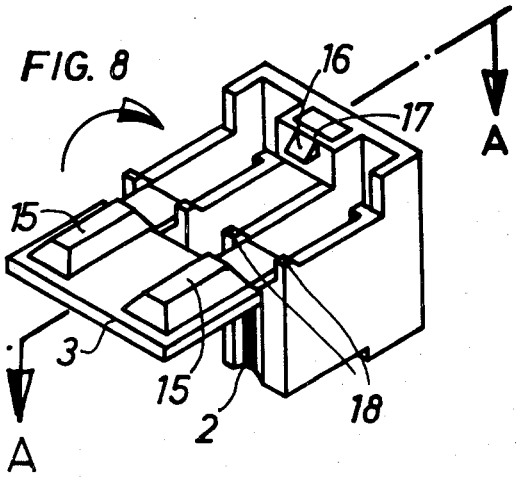
FIG. 8 is an insulating block for a plurality of flat connectors.
Figure 9:
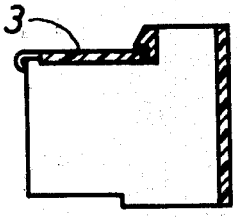
FIG. 9 is a section along the line A—A through the insulation block according to FIG. 8.

In FIG. 8, an insulation block for a plurality of flat connectors is shown, where the cover lid 3 is locked with a single latch 16 provided on a flexible wall portion 17 instead of with locking latches 9. Fixing poles 18 absorb the tensional forces generated when closing closure lid 3 and bending hinge frame 4 and at the same time support against the latch, or latches 16, respectively.

Figure 10:
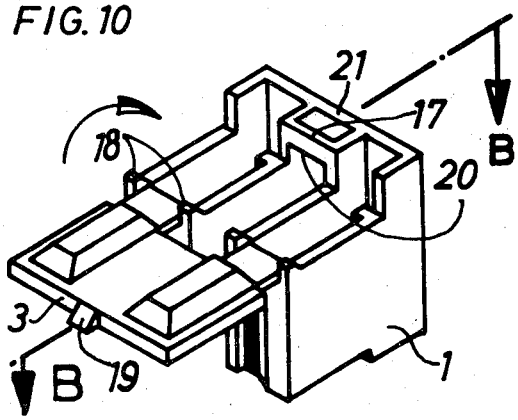
FIG. 10 is a further embodiment of an insulation block for a plurality of flat connectors.
Figure 11:
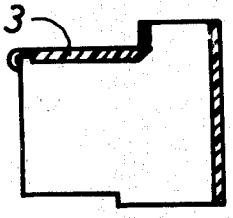
FIG. 11 is a section along the line B—B through the insulation block according to FIG. 10.

FIG. 10 shows a further embodiment of the insulation block, the closure lid of which includes locking latch 19 engaging behind the lower edge 20 of flexible wall portion 17.

The locking of the closure lid by a locking latch 16 on flexible wall portion 17 or by means of lower edge 20 of flexible wall portion 17 on a locking latch 19 on closure lid 3, offers in view of the employment of the flexibility of flexible wall portion 17 a particularly simple, easy and yet safe closure, which is protected by the rear wall portion 21. With a view to the simplicity, very small dimensions, i.e. very small insulation housings, are rendered possible, which have contact chambers into which the flat connectors may laterally be embedded and which by means of integrally attached closure lids may safely be secured so that they cannot be pushed out of the insulation housing by any forces that might occur in the employment thereof.

I claim:

1. Insulation apparatus for flat connectors comprising a unitary plastic housing including a first narrow side wall and a second side wall extending substantially transversely to said first side wall, an embedding opening being formed in said first side narrow wall and an insertion opening being formed in said second side wall, a lid integrally connected to said housing by a hinge frame proximate to said insertion opening such that said lid is rotatable to partially close said embedding opening, and at least one latch means integrally formed on said housing for arresting said lid when the latter closes said embedding opening.

2. Insulation apparatus for flat connectors comprising a unitary plastic housing including a first narrow side wall and a second side wall extending substantially transversely to said first side wall, an embedding opening being formed in said first narrow side wall and an insertion opening being formed in said second side wall, a lid integrally connected to said housing by a hinge frame proximate to said embedding opening such that said lid is rotatable to partially close said embedding opening, and at least one latch means integrally formed on said housing for arresting said lid when the latter closes said embedding opening.

3. Insulation apparatus according to claim 2 wherein on the interior of one side wall of said housing a bar is provided adapted to arrest the beaded portions of an embedded flat connector, said bar extending from said embedding opening at right angles relative to the direction in which a contact or the like is inserted through said insertion opening.

4. Insulation apparatus according to claim 3, wherein said housing is further defined by a side wall situated in opposed relationship to said insertion opening and which is at least partly slotted from said embedding opening.

5. Insulation apparatus according to claim 4, wherein the clearance provided by said slot in said slotted wall corresponds to the thickness of a cable extending from said connector so as to constitute a cable exit.

* * * * *